United States Patent [19]

Luginbühl

[11] Patent Number: 4,748,305

[45] Date of Patent: May 31, 1988

[54] GAS-BLAST SWITCH

[75] Inventor: Charles Luginbühl, Neuenhof, Switzerland

[73] Assignee: BBC Brown Boveri, AG, Switzerland

[21] Appl. No.: 27,637

[22] Filed: Mar. 19, 1987

[30] Foreign Application Priority Data

Mar. 26, 1986 [CH] Switzerland ..... 1213/86

[51] Int. Cl.[4] ..... H01H 33/60

[52] U.S. Cl. ..... 200/148 R; 200/150 B; 200/148 B

[58] Field of Search ..... 200/148 R, 150 B, 148 B

[56] References Cited

U.S. PATENT DOCUMENTS 3,271,548 9/1966 Kesselring ..... 200/148 B

FOREIGN PATENT DOCUMENTS

3321740A1 11/1984 Fed. Rep. of Germany .
7435812 12/1975 France .

*Primary Examiner*—Robert S. Macon

*Attorney, Agent, or Firm*—Ostrolenk, Faber, Gerb & Soffen

[57] ABSTRACT

A gas-blast switch has a housing which encloses an arcing chamber, an accumulator space and an expansion space. Two relatively moveable contact members are arranged in the housing. One of the contact members moves through a nozzle. The nozzle is formed of and defined by two moveable nozzle parts, the relative position of which determines the size of a discharge cross-section in the nozzle. During a switching-off operation, the moveable contact member moves out of the arcing chamber and quenching gas flows from the accumulator space into the expansion space, through the arcing chamber, i.e. the nozzle. The size of discharge cross-section of the nozzle varies through movement of the nozzle parts which respond to pressure created in the switch, without the assistance of elaborate compression springs. To this end, the nozzle parts are freely mounted to move in response to pressures generated in the switch and they are disposed in the gas path between the arcing chamber and the accumulator space.

12 Claims, 3 Drawing Sheets

GAS-BLAST SWITCH

BACKGROUND AND SUMMARY OF THE INVENTION

The invention relates to a gas-blast switch.

The invention is of the general type that is described in the prior art Gas-blast switches, as represented for example in FIGS. 1 and 2 of DE-No. A1-33 21 740. The known switch has a housing enclosing an arcing chamber, an accumulator and an expansion space. Two relatively moveable contact members, one of which can be guided through a nozzle, are arranged in the housing. The nozzle opening is variable along its discharge cross-section. This is attained by moveable nozzle parts which are guided inward by means of compression springs when the gas-blast switch is switched off. This reduces the discharge cross-section of the nozzle at switch off and thus the pressure loss upon discharge of extinguishing gas from the accumulator or from the arcing chamber via the nozzle into the expansion space is reduced.

The invention has the object of creating a gas-blast switch in which the discharge cross-section of the nozzle is variable, independently of the action of elaborate compression springs.

The gas-blast switch according to the invention is characterized by simple design and by a nozzle whose discharge cross-section is essentially determined by the pressure conditions in the arcing chamber and in the accumulator. Elaborate compression springs are dispensed with. Furthermore, the possible occurrence of welding effects at the nozzle parts is eliminated in a simple manner.

BRIEF DESCRIPTION OF THE DRAWINGS

The invention is explained below in more detail with reference to several exemplary embodiments. In the drawings.

DETAILED DESCRIPTION OF THE PREFERRED EMBODIMENT

Figure 1:
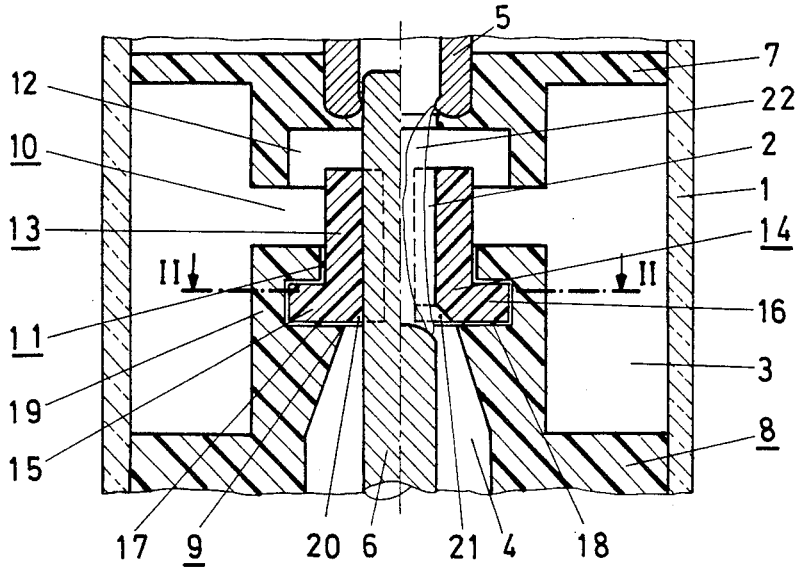
FIG. 1 is a plan view of a section taken in axial direction through a first embodiment of the gas-blast switch according to the invention.

Corresponding parts are provided with the same reference symbols in all figures. In a first embodiment of the gas-blast switch according to the invention, represented in FIGS. 1 to 3, 1 denotes a tubular housing of insulating material, which is filled with an insulating gas, such as sulfur hexafluoride at, for example, a few bars pressure. The housing encloses in its basic form an arcing chamber 2, an accumulator 3 and an expansion space 4. Arranged in housing 1 are a fixed contact member 5, of essentially cylindrical design and connected to a power point (not shown), and a moveable contact member 6, likewise of essentially cylindrical design and connected to a power point (not shown). The contact member 5 is tube shaped, while the contact member 6 has the shape of a pin. However, it is also possible for the contact member 5 to be designed as a pin and the contact member 6 to be designed as a tube, or both contact members to be designed as tubes or as pins.

Figure 3:
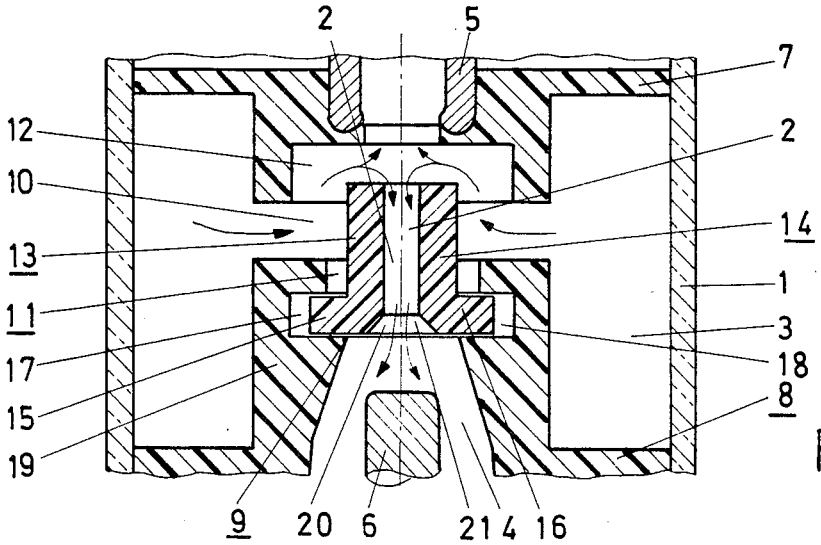
FIG. 3 is a plan view of the section taken in axial direction through the gas-blast switch according to FIG. 1, in the switched-off position.

In the interior of the housing 1 there are two insulating material elements 7 and 8, arranged axially opposite one another relative to the housing's axis. The insulating material element 7 bears the contact member 5 and the insulating material element 8 bears a nozzle 9. The two insulating material elements 7, 8 define with their sides facing each other accumulator 3 coaxially surrounding the contact members 5, 6. A channel 10 hollowed out between the insulating material elements 7, 8 joins the accumulator 3 to the arcing chamber 2 during switching off (FIG. 1, right-hand half) and in the switched-off position (FIG. 3).

In each of the sides facing each other of the two insulating material elements 7, 8 there is a groove 11, 12. Two nozzle parts 13, 14 made of insulating material are displaceably guided transverse to the axis of the housing 1 in the groove 11, provided in the insulating material element 8. The nozzle parts 13, 14 have on each of the sides facing each other a dish-shaped surface, adapted to the contact member 6, and also a guide element 15, 16, which in each case is displaceably mounted in an undercut region 17 and 18, respectively, of the groove 11, extending transverse to the direction of movement of the nozzle parts 13, 14 and transverse to the axis of the housing 1. The nozzle parts 13, 14, together with a shoulder 19 integrally attached to the insulating material element 8 and of hollow design, form the nozzle 9, by which the arcing chamber 2 and thus also the accumulator 3 are joined to the expansion space 4 during a switching off operation. The ends of the nozzle parts 13, 14 facing the contact member 5 are guided in the groove 12. The ends of the nozzle parts 13, 14 facing away from the contact member 5 have conical surfaces 20, 21.

The gas-blast switch operates as follows: In the on position (left-hand side of FIGS. 1 and 2), the contact member 6 passes through the nozzle 9 and enters the hollow contact member 5. The nozzle parts 13 and 14 are pressed apart by the contact member 6 and are positioned against the outside of the contact member 6, their dish-shaped surfaces making contact with contact member 6.

Figure 2:
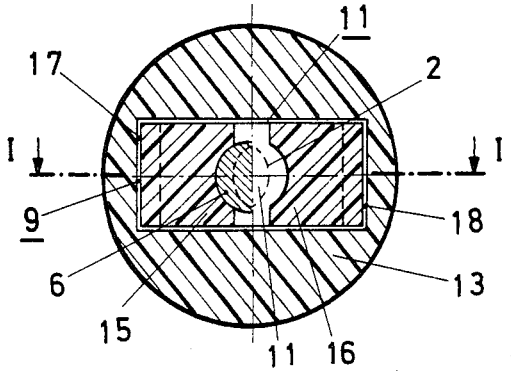
FIG. 2 is a plan view of a section taken along line II—II through the gas-blast switch according to FIG. 1.

During switching off, contact member 6 is moved downwardly by a drive mechanism (not shown) and, as soon as the contact members 5 and 6 are disengaged, an arc 22 is produced between them in arcing chamber 2 (right-hand halves of FIGS. 1 and 2). Gas heated up by the arc 22 flows from the arcing chamber 2 through the channel 10 containing the groove 12 into the accumulator 3, where it is stored as compressed gas. Owing to the high pressure in the arcing chamber 2, the nozzle parts 13, 14 remain pressed apart during the high-current phase of the current to be disconnected even after the contact member 6 has moved out of the opening of the nozzle 9 (right-hand halves of FIGS. 1 and 2).

When the current to be disconnected approaches zero, the pressure in the arcing chamber 2 decreases.

When the pressure of the gas in the accumulator 3 exceeds the pressure of the gas in the arcing chamber 2, gas flows from the accumulator 3 via the channel 10 into the arcing chamber 2, and from there through the opening of the nozzle 9 into the expansion space 4. This causes nozzle parts 13 and 14, which are mounted essentially free from forces, to move toward one another. Thereby—as is evident from FIG. 3 and from the representation shown in broken lines in FIG. 2—the discharge cross-section of the nozzle 9 is reduced considerably.

In this way, extreme pressure loss prior to the current reaching zero is avoided through exceedingly simple measures and without using spring elements. Consequently, sufficient compressed gas is available in a simple way for blowing out the arc. Possibly occurring welding effects of the nozzle pars 13 and 14 are broken up in this case by the moveable contact member 6 which strikes the facets 20, 21 during a switching on operation.

Figure 4:
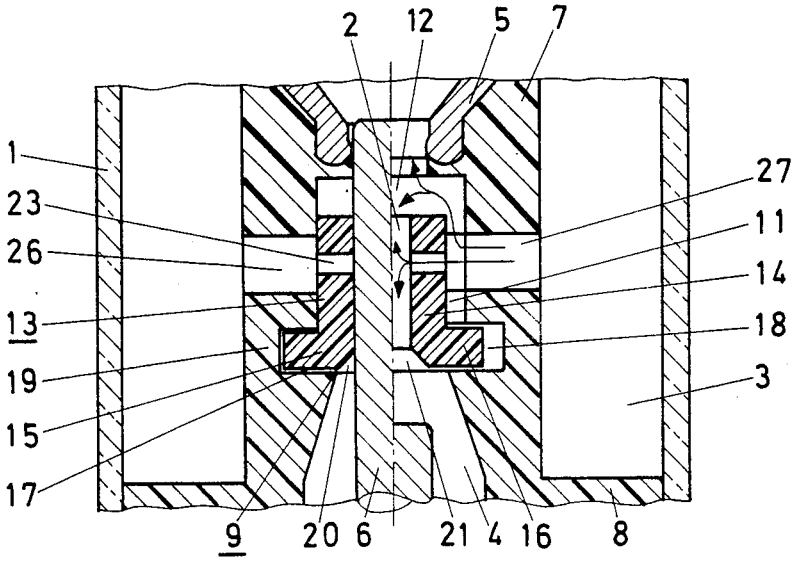
FIG. 4 is a plan view of a section taken in axial direction through a second embodiment of the gas-blast switch according to the invention.

In the embodiment according to FIG. 4, the insulating material elements 7 and 8 are shaped to form a one-piece element. This element contains two channels 26, 27, which are functionally identical to the channel 10 and join the arcing chamber 2 to the accumulator 3 in the off state. The groove 12 is designed in such a way that the route running via the two channels 26, 27 and the groove 12 from the arcing chamber 2 to the accumulator 3 is interrupted by the nozzle parts 13 and 14 in contact with the walls of the groove 12 during the high-current phase. During the high-current phase, the gas heated up by the arc is conducted via bore holes 23 in the nozzle parts 13 and 14 from the arcing chamber 2 into the accumulator 3. On approaching a current of zero, the route passing from the channels 26 and 27 via the groove 12 also opens and then the arc can be blown out both via the bore holes 23 and via the groove 12, i.e. in two modes (cf. right-hand half of FIG. 4).

Figure 5:
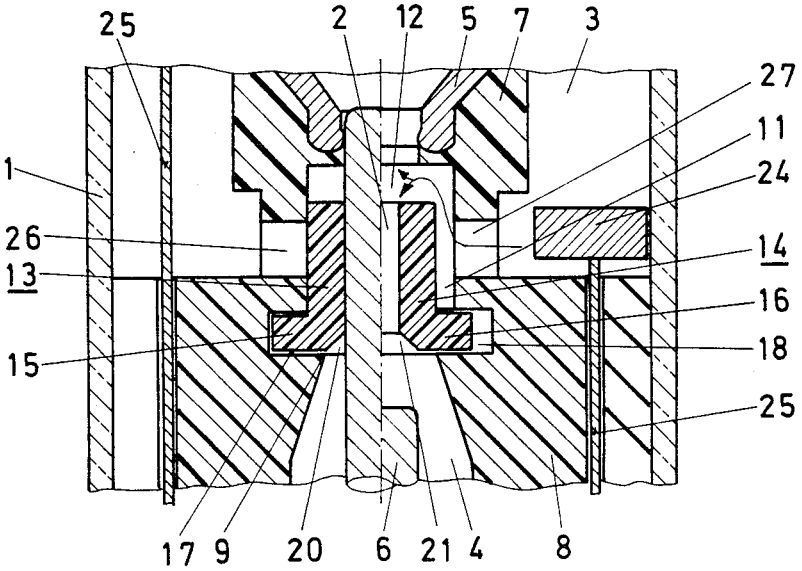
FIG. 5 is a plan view of a section taken in axial direction through a third embodiment of the gas-blast switch according to the invention.

The embodiment of the blast-gas switch according to the invention as shown in FIG. 5 corresponds essentially to that shown in FIG. 4, but the bore holes 23 are eliminated and, furthermore, the accumulator 3 is designed as compression volume of a piston-cylinder compression device whose piston 24 is connected non-positively via a linkage 25 to the drive mechanism (not shown) of the switch. As a result of the high gas pressure in the arcing chamber 2 in the high-current phase, the nozzle parts 13 and 14 are pressed against the walls of the groove 12 and the route between the arcing chamber 2 and the accumulator 3 is interrupted. At the same time, the pressure of the gas in the accumulator 3 is increased by downward movement of the piston 24 moved by the switch drive mechanism. While heavy currents are still flowing, the high pressure formed in the arcing chamber 2 in the high-current phase is prevented from having an effect in the accumulator 3 via the channels 26, 27 and for instance blocking the piston 24 coupled to the drive mechanism. When approaching a current of zero, the gas pressure in the accumulator 3 is greater than in the arcing chamber 2. The nozzle parts 13 and 14 are moved inward by the gas in the accumulator 3, which is supplied via the two channels 26 and 27, and the arc is blown out by a particularly fresh extinguishing gas with a small discharge cross-section of the nozzle 9.

Figure 6:
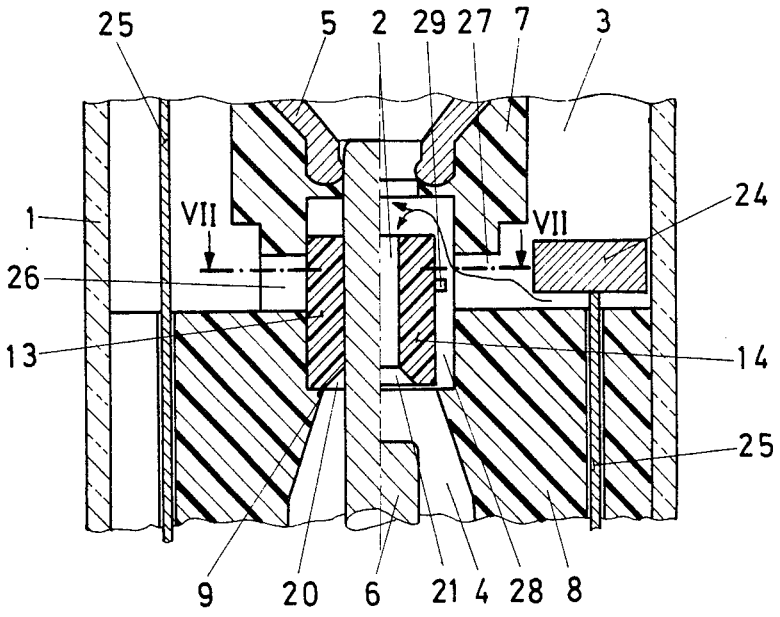
FIG. 6 is a plan view of a section taken in axial direction through a fourth embodiment of the gas-blast switch according to the invention.
Figure 7:
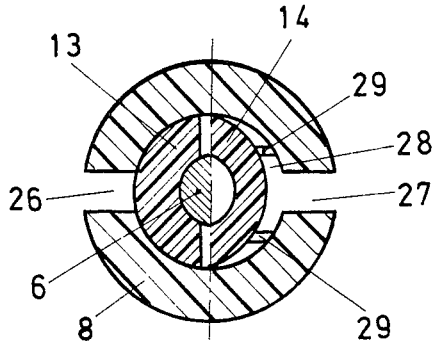
FIG. 7 is a plan view of a section taken along line VII—VII through the gas-blast switch according to FIG. 6.

The embodiment of the gas-blast switch according to the invention as shown in FIGS. 6 and 7 corresponds in essential parts to that as shown in FIG. 5, but the grooves 11, 12 provided in the insulating material elements 7, 8 which are combined to form a single element are now designed as cylindrical recess 28. Mounted in this recess 28 are the nozzle parts 13, 14, designed as cylinder half-shells. The nozzle parts 13, 14 are guided on pin-shaped guide elements 29 of the insulating material elements 7, 8 combined to form a single element.

These measures make it possible for the gas-blast switch according to the invention to be produced in a particularly cost-effective way while retaining its advantageous properties, since in this way for instance the comparatively expensive milling out of undercuts and square shaped grooves is dispensed with.

I claim:

1. A gas-blast switch, comprising:

a housing;

an arcing chamber, an accumulator space, and an expansion space, all defined within said housing;

first and second contact members which are movable relative to one another, said first contact member being mounted to be movable through said arcing chamber toward and away from said second contact member; and said arcing chamber being defined, at least partially, by a nozzle having a variably sized discharge cross-section, said nozzle being comprised of and defined by movable nozzle parts, the relative position of said nozzle parts determining the size of said discharge cross-section, said movable nozzle parts being disposed at least partially in a path which leads from said arcing chamber to said accumulator space and said movable nozzle parts being freely mounted in said housing such that the size of a spacing between said movable nozzle parts is controlled by gas pressure which is exerted on said nozzle parts in response to an arc that develops in said housing.

2. The gas-blast switch according to claim 1, wherein said nozzle parts are mounted to be movable relative to one another and further including an insulating material element which support said nozzle, said nozzle parts being guided in said insulating material element.

3. The gas-blast switch according to claim 2, wherein said movable nozzle parts are each in the shape of a cylindrical half-shell and further including guide elements in said insulating material element for guiding said movable nozzle parts.

4. The gas-blast switch according to claim 2, further including a first groove in said insulating material element and said nozzle parts being guided in said first groove.

5. The gas-blast switch according to claim 4, including an undercut region in said first groove and a guide element disposed in said nozzle parts, the guide member being mounted to be movable in said undercut region.

6. The gas-blast switch according to claims 4 or 5, further including a second groove, disposed in the path between said arcing chamber and said accumulator space and another insulating material element which supports the second contact member, said nozzle parts being additionally guided in said second groove.

7. The gas-blast switch according to claim 6, wherein said second groove communicates spacially with said accumulator space, in a switch-on state associated with said gas-blast switch.

8. The gas-blast switch according to claim 6, wherein a path extending via said second groove and communicating into said arcing chamber and into said accumulator space is selectively blocked by said nozzle parts, said selective blocking taking place at a location between said second groove and said accumulator space.

9. The gas-blast switch according to claim 8, further comprising bore holes extending through said nozzle parts and effective for providing a communication path between said arcing chamber and said accumulator space.

10. The gas-blast switch according to claims 1, 2, 3, 4 or 5, wherein each of said nozzle parts comprises a respective dish-shaped surface which is shaped to conform to said first contact member and a respective conical surface which is disposed to be struck by said first contact member during movement of said first contact member toward said second contact member in a switching on operation.

11. The gas-blast switch according to claim 1, wherein said nozzle parts are so mounted in said housing that when an arcing current flowing between said first and second contact members has a nonzero value, said nozzle parts are relatively separated from one another to define a largest discharge cross-section in said arcing chamber and when said arcing current has a value of about zero, a pressure distribution in said housing is effective to move said nozzle parts relatively closer to one another to narrow said discharge cross-section.

12. The gas-blast switch according to claim 1, further including piston means disposed in said accumulator space and effective for controlling, at least partially, a gas pressure that exists in said accumulator space.

* * * * *